US005388804A

United States Patent [19]

Cohen et al.

[11] Patent Number: 5,388,804

[45] Date of Patent: Feb. 14, 1995

[54] ANCHOR BOLT HOLDER-SPACER

[76] Inventors: Jack H. Cohen, 9995 Dover Cyn. Rd., Templeton, Calif. 93465; Robert C. Brooks, 3820 N. River Rd., Paso Robles, Calif. 93446

[21] Appl. No.: 95,390

[22] Filed: Jul. 19, 1993

[51] Int. Cl.[6] ..... E04G 17/00; E04B 1/41

[52] U.S. Cl. ..... 249/210; 52/699; 249/91; 249/93; 249/207

[58] Field of Search ..... 249/91, 93, 207, 210, 249/211, 219.1; 52/295, 677, 699, 700

[56] References Cited

U.S. PATENT DOCUMENTS

| | | | |
|---|---|---|---|
| 1,199,077 | 9/1916 | James | 249/210 |
| 1,726,286 | 8/1929 | Bennet | 52/699 |
| 1,960,728 | 5/1934 | Cannon | 52/699 |
| 3,150,429 | 9/1964 | Shaffer | 249/207 |
| 3,912,218 | 10/1975 | Lister | 249/207 |
| 3,963,210 | 6/1976 | Macklin | 249/210 |
| 3,964,219 | 6/9197 | Hala | 52/699 |
| 4,087,947 | 5/1978 | Turner | 52/699 |
| 4,118,910 | 10/1978 | McSherry et al. | 52/699 |
| 4,261,544 | 4/1981 | Addison | 249/207 |
| 4,404,781 | 9/1983 | Gilb | 52/295 |
| 4,412,407 | 11/1983 | Melfi et al. | 52/699 |
| 4,413,456 | 11/1983 | Gilb | 52/295 |
| 4,640,063 | 2/1987 | Ayala | 52/127 |
| 4,641,478 | 2/1987 | Nelson, Jr. | 52/700 |
| 4,736,554 | 4/1988 | Tyler | 52/105 |
| 4,739,598 | 4/1988 | Jenson et al. | 52/295 |
| 5,042,218 | 8/1991 | Nasca | 52/677 |
| 5,050,364 | 9/1991 | Johnson | 52/705 |
| 5,060,436 | 10/1991 | Delgado | 63/295 |

*Primary Examiner*—James P. Mackey

[57] ABSTRACT

A device that is used to hold a bolt in place while concrete is poured around it, so that when the concrete has hardened the bolt will protrude vertically, a useful distance from the surface of the concrete, and will be positioned in a useful place. The shaft of the bolt is held at more than one separated points by the device. The device has an upper arm and lower arm which project away from the shaft of the bolt to rest upon the inside face of a side-abutment container form board. The device has a clip for connecting to and hanging from this form board. The device is also formed or bent to create a seat for the placement of re-bar. The device is positioned in such a way, so that once poured, concrete will cover everything but its clip. The uncovered clip can be bent or twisted to break it away from the parts of the device encased in concrete. This is done after the concrete has hardened.

13 Claims, 3 Drawing Sheets

FIG. 5
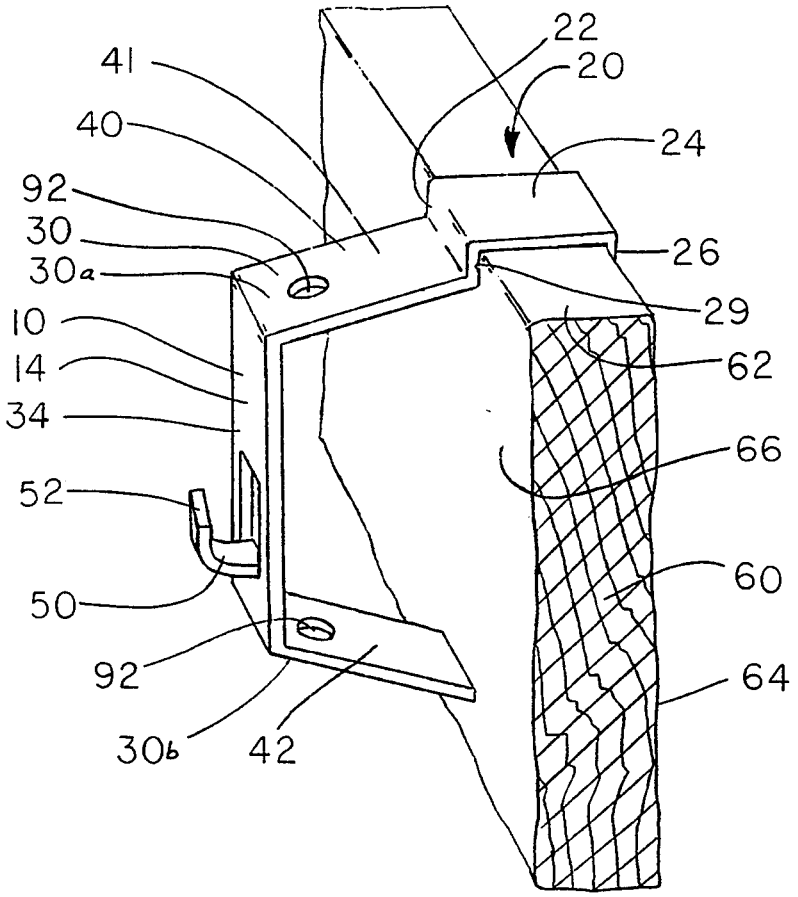
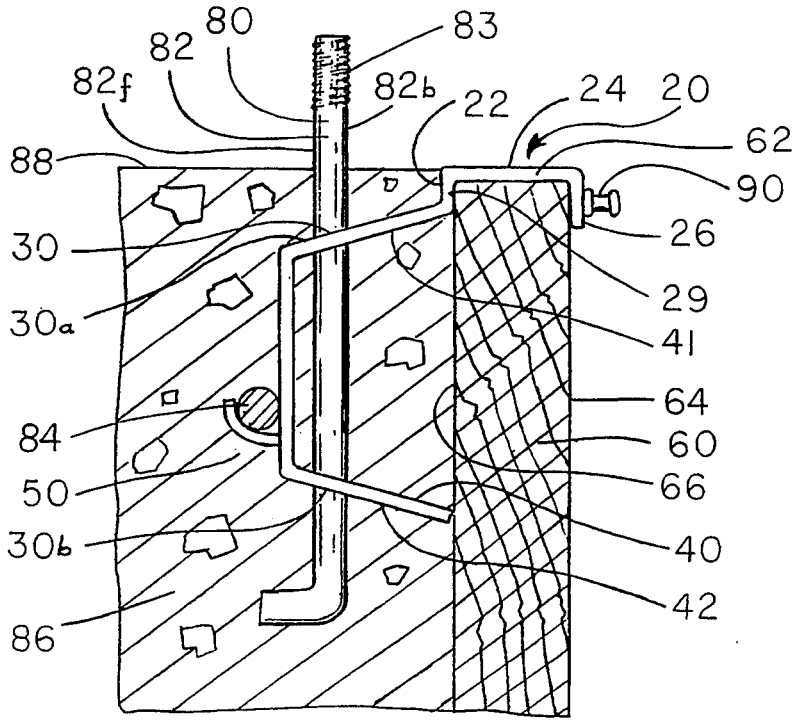
FIG. 6

ANCHOR BOLT HOLDER-SPACER

BACKGROUND

1. Field of the Invention

This invention relates to anchors and bolts used to secure plates and framing of a building to its foundation and/or slab, and in particular to the setting of anchor bolts or hold down bolts, and/or re-bar, after forming, but before the placement of concrete.

2. Description of Prior Art

Hand-set Bolts

The usual way that a foundation or slab floor of a building is constructed is to build perimeter formwork to contain the wet concrete to be poured. Steel in the form of re-bar is placed within this formwork. A wet unset concrete mixture is poured into the area contained by the formwork and the top edge of the formwork is used as a guide for determining the level of this concrete.

Anchor bolts or hold down bolts, which are both steel rods of varying length and diameter, are incorporated into this concrete. Each bolt, usually threaded at one end, is placed so that this threaded end projects vertically from the concrete of the slab or footing. A portion of the part of rod remaining in the concrete is usually bent perpendicularly or into some other configuration to increase its pullout resistance. After the concrete has hardened, a plate or mudsill of wood or metal is marked to locate each bolt position. These locations are then drilled. The plate is placed over the protruding bolt ends, and is tightly secured by nuts and washers fastened to these protruding bolt ends. It is this connection which secures a building to its foundation. The usual method of incorporating these bolts into the foundation is accomplished by having a worker hand set them in the wet concrete after the concrete has been screeded level.

Concrete foundations and slabs are also constructed using a two pour method of concrete foundation construction. With this method, concrete for the perimeter footing is poured first, its top level being about four inches lower than the level of the finished slab. After this concrete has hardened, a new mix of concrete for the slab is poured, covering this footing and filling the formwork to its finished level.

A problem with hand setting bolts in wet unset concrete, is the difficulty of maintaining standards of accuracy in the positioning of these bolts. One reason for this difficulty is that time is usually in short supply between the start of placement of the concrete and the steel trowel finishing of the surface of the concrete. Therefore, there is not extra free time to be devoted to the exact placement of bolts. Another reason for this difficulty is that often the least experienced worker on the job is the worker doing the placement. He may not have the training or experience necessary for the understanding of the importance of maintaining placement standards. Maintaining these standards is also difficult as at times the concrete does not have sufficient body to support the position of a placed bolt.

When these standards are not maintained, several costly consequences will result. Should the threaded end of the bolt not protrude sufficiently to allow its passage through the thickness of a mud sill, time and effort must be spent on chiseling out around the bolt hole through the sill. If the protruding bolt is out of plumb, its shaft may need to be bent back to vertical, damaging the bond of the bolt to the concrete, or weakening the shaft of the bolt.

Another problem with hand setting bolts, is that bolt location cannot be inspected before the placement of concrete. An insufficient number of bolts may be placed requiring the expensive addition of drilled and placed bolt systems. Also bolts may be placed at incorrect locations requiring their time consuming removal at a later date.

A further problem with the hand setting method is that the shaft of the bolt may not have a tight connection to the concrete. This occurs when the concrete of a slab has set to a point where it is no longer fluid and a void is formed around the shaft of a bolt forced into it.

Pre-set Bolts

To solve some of the aforementioned problems, contractors and inventors have resorted to several different methods to preset their bolts. One of these methods is created by drilling a hole in a board to accept the threaded top of a bolt. The bolt is pushed through this hole and a nut is threaded on to the bolt. This board is then nailed to the top of the form board, hanging the bolt into a position so that its threaded end will be free of, and its other end will be covered by the placed concrete. The board itself is positioned to be above the surface of the concrete. Once the concrete has hardened sufficiently to hold the bolt into position, the nails holding the board to the form board are removed, the nut holding the bolt to the board is removed, and the board is removed from the shaft of the bolt protruding from the concrete. There is a plastic hanger that has been manufactured, that holds and suspends a bolt in basically this same way.

One of the drawbacks with this method of setting an anchor bolt is that the bottom of the anchor bolt or hold down is not secured so that during the placement of the concrete the shaft of the bolt is often knocked out of plumb. Another problem with this method is that fastening the anchor bolt to the holder is a time consuming activity. Another problem with this method is that the hanger device must be removed after placement of the concrete in order to finish the concrete under it and this is a time consuming activity. A further problem with this method is that the hanger devices must be cleaned and carried from one job to another. Another problem is that a certain number of these devices break during use and new ones must be bought in order to maintain a sufficient inventory.

Embossed and bent sheetmetal mudsill anchors, such as is found illustrated in Gilb (U.S. Pat. No. 4,413,456), are manufactured by several companies. These are set by nailing to a form board before the placement of concrete. Each one is positioned so that about one-half of its length will be buried and held by the to-be-placed concrete. The other half remains free of the concrete. After the concrete is placed and hardened, this free section of strapping is disconnected from the form board, bent up and over the mudsill, and is nailed to the mudsill. With this device the mudsill cannot be torqued down as can be done with the nut and bolt arrangement of the anchor bolt. Because of this it is not as popular with contractors as the anchor or hold down bolt.

Re-bar Placement

In concrete construction re-bar is used to add to the structural strength of the concrete slab or footing. The re-bar used in concrete construction has certain placement requirements in order for it to be most efficient in this. Correct placement is also necessary to insure that sufficient concrete covers the re-bar protecting it from the oxidative effects of contact with water. Among the several ways to position re-bar before the placement of concrete is to hang it using tie wire that is attached to the form board. This method is time consuming and does not result in very accurate placement of the re-bar. Re-bar also is positioned by setting it on the ground inside the formed area and pulling it into position during placement of the wet concrete mixture. The concrete mixture then holds it in place. This method does not allow for inspection of the final positioning of the re-bar before the concrete placement.

Re-bar can also be placed in position using the sheetmetal mudsill anchor. This anchor contains a re-bar seat at its end that will be buried within the concrete. A problem with this device is that a blow to the re-bar holder or the re-bar can cause detachment of the anchor from the form board. As previously mentioned, most contractors do not like to use mud sill anchors.

Another device that is used to place re-bar is a hanger that is formed from bent wire. Such a device is illustrated in Frost (U.S. Pat. No. 5,042,218). The problem with this device is that it is prohibitively expensive.

OBJECTS AND ADVANTAGES

It is an object of this invention to allow for bolts to be set after forms have been built but before the concrete has been placed in these forms. This allows for inspection and correction of the placement and position of these bolts. Pre-placed bolts can be positioned to tie in or be in close proximity to the re-bar in the slab or footing, improving the strength of the structure of the building. The pre-placement of bolts made possible with this invention also allows for their installation without a problem of voids forming around shafts of the bolts.

A further object of this invention is to provide a way to hold bolts so that they may be in a useful position to speed the construction process. This is accomplished by providing a device that holds each bolt so that its threaded end stands to the correct height from the horizontal surface of the finished slab. This device also holds a bolt so that it is spaced consistently and correctly from the finished edge of the slab and so its shaft is in a vertical or plumb position.

A further object of the invention is to more securely hold and position a bolt then is accomplished by the use of methods and devices known today. With this invention more of the shaft of the bolt is held and secured so that it is difficult to change the position of the bolt or knock it out of plumb.

Another object of this invention is to do away with a hanger that is positioned above the slab and so can be reused. Doing away with this hanger eliminates the labor that is required to attach and detach it to a bolt and form board, and eliminates the labor required to float and finish the surface of the concrete under it. Eliminating this hanger also eliminates the labor required to clean them and eliminates the need for space to store them.

Another object is to make use of this invention when using a two pour method of slab construction. By holding the form board in place, the stakes used in the construction of the formwork may be removed, easing the finishing process.

Another object of the invention is to provide a seat upon which to place and hold re-bar so that it is held in a useful position within close proximity to anchor bolts. This adds to the strength of the structure of the building. A further object is to provide solid support for this seat and for the invented device itself.

A further object is to provide a device that can hold both a bolt and re-bar, or can, if required, hold only a bolt or, hold only re-bar.

A further object of this invention is to accomplish all of the above with the creation of a device that is inexpensive and cost effective to use.

Further objects and advantages of our invention will become apparent from a consideration of the drawings and ensuing description.

DRAWING FIGURES

FIG. 5 is a perspective view of a sheetmetal embodiment of the invention.

FIG. 6 is a side view of a the sheetmetal embodiment of the invention, after concrete has been placed.

REFERENCE NUMBERS IN DRAWINGS

Figure 1:
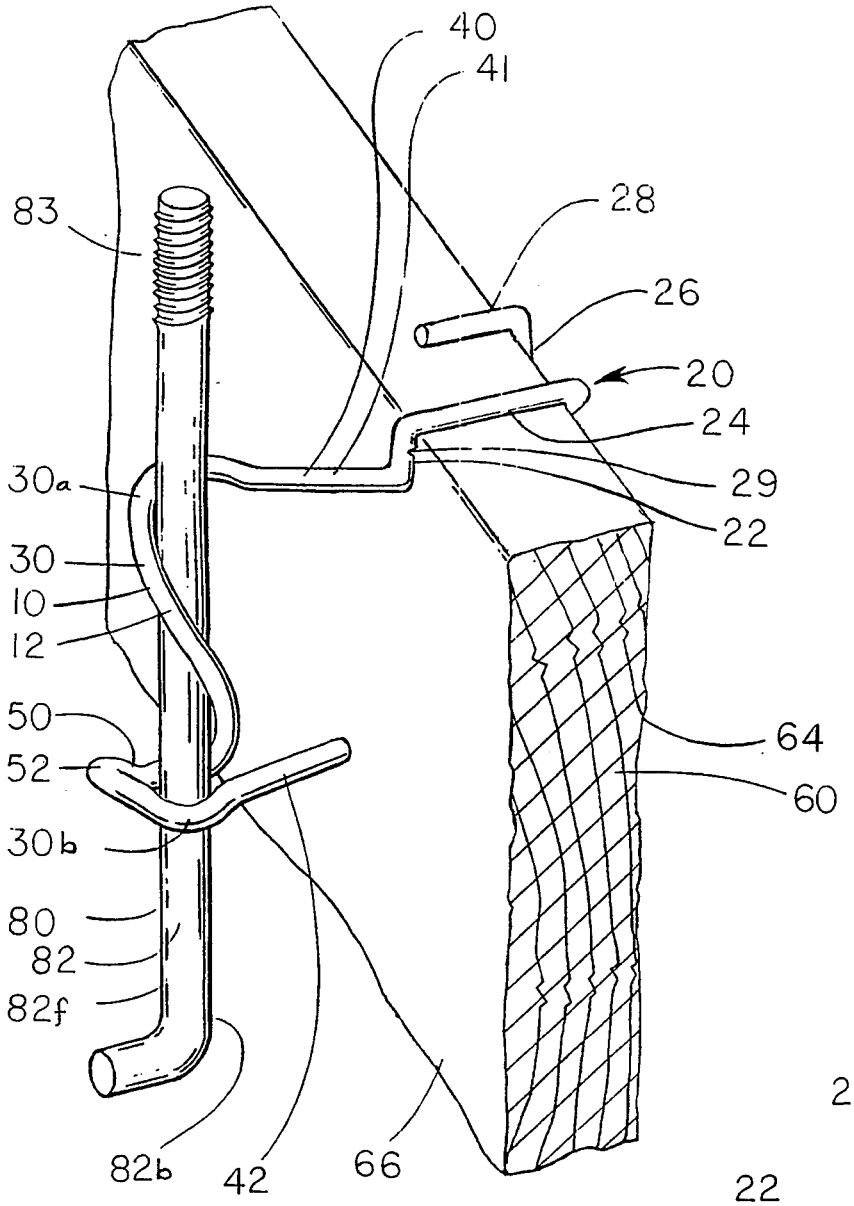
FIG. 1 is a perspective view of the preferred embodiment of the present invention in place on form board with anchor bolt installed.
Figure 2:
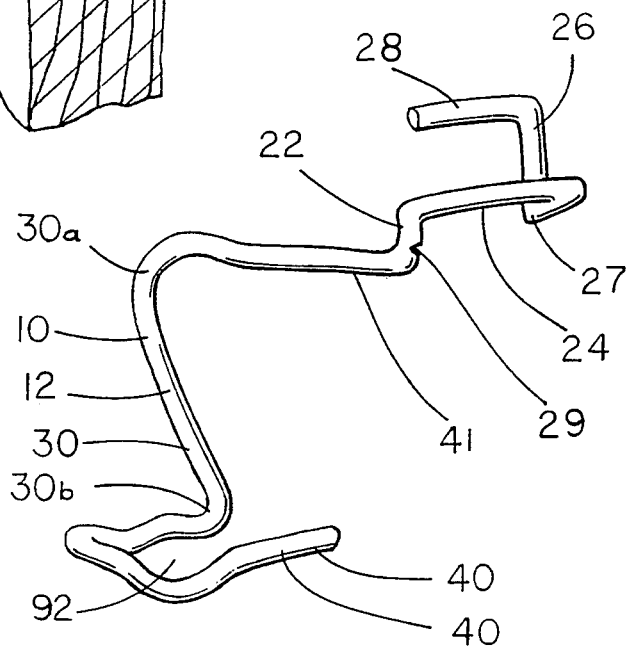
FIG. 2 is a perspective view of the preferred embodiment of the present invention without form board or bolt installed.
Figure 3:
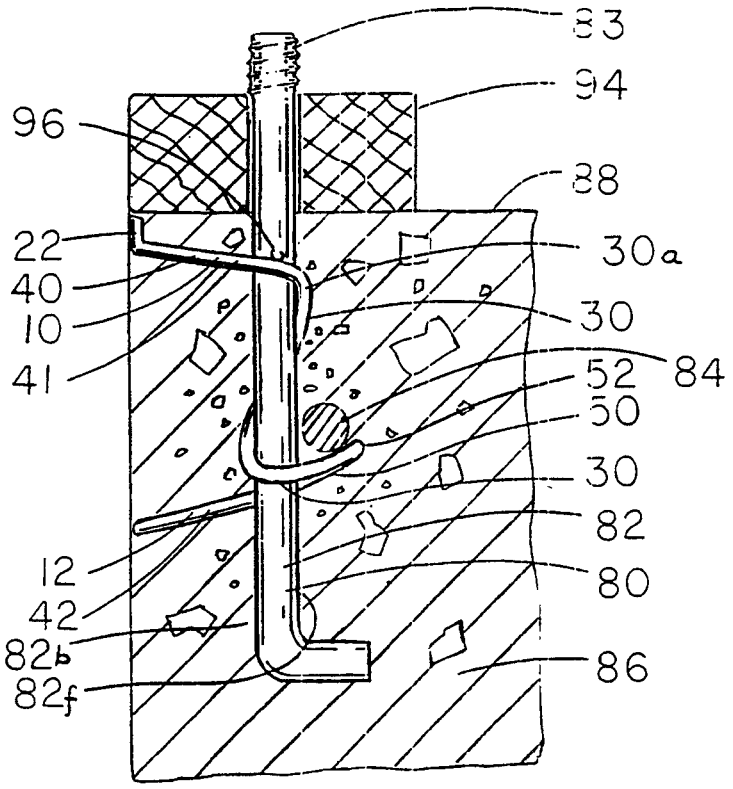
FIG. 3 is a side view of the preferred embodiment after placement and hardening of concrete, with form board and attachment clip removed, and with mudsill in place.

10 bolt holder-spacer device
12 wire
14 sheetmetal
20 form board attachment clip
22 inboard leg
24 connecting leg
26 outboard leg
27 V-shaped bend
28 stabilizing leg
29 break-off point
30 bolt-holder section
**30*a*** upper bolt-holder section
**30*b*** lower bolt-holder section
34 vertical-connecting section
40 spacer-arm
41 upper spacer-arm
42 lower spacer-arm
50 re-bar seat
52 re-bar seat end-point
60 form board
62 top edge of form board
64 outside face of form board
66 inside face of form board
80 anchor bolt
82 anchor bolt shaft
**82*b*** backside
**82*f*** frontside
83 threaded end
84 re-bar
86 concrete
88 top surface of finished concrete
90 duplex nail
92 opening for inserting bolt
93 hole for inserting and holding bolt
94 mudsill 96 protrusion

DESCRIPTION OF THE INVENTION

The instant invention of FIG. 1–5 is a bolt holder-spacer device 10 which consists of a piece of wire 12 or a piece of sheet metal 14 that is bent and shaped into a bolt holder section 30 including both an upper bolt-holder section 30*a* and a lower bolt-holder section 30*b*. These can be connected to an anchor bolt shaft 82 or hold down bolt shaft. The attachment of this connection can be achieved by welding, gluing, taping, or forming the sheet metal or wire in such a way as to create a mechanical attachment. This attachment can be accomplished by bending wire 12 to tightly wrap around anchor bolt shaft 82. Anchor bolt shaft 82 can have a protrusion 96 or notch which contacts a point of a mechanical attachment provided within either upper bolt holder section 30*a* or lower bolt holder section 30*b*.

The invention also has a spacer-arm or spacer-arms 40, which can consist of an upper spacer-arm 41 and a lower spacer-arm 42 that project from the vicinity and are connected to upper bolt-holder section 30*a* and lower bolt-holder section 30*b* at the upper and lower section of anchor bolt shaft 82. These arms travel until they come in contact with a form board 60 or more specifically, with an inside face of form board 66. They space bolt holder section 30, and so bolt shaft 82, a required distance from this inside face 66.

Attached to the end of upper spacer-arm 41 is a form board attachment clip 20. This clip is bent to travel up from its attachment to arm 41, over a top of form board 62, and partially down a outside face of form board 64. On certain wire formed embodiments of the invention, the wire of the clip is bent to return up outside face 64 and to return back over top edge of form board 62 creating a stabilizing leg 28. Where the wire has been bent to return up, a V-shaped bend is formed 27. Here a duplex nail 90 can be used to secure device 10 to form board 60. A re-bar seat 50 is formed in both the sheet metal and wire versions of the invention to hold re-bar 84 in position.

PREFERRED EMBODIMENT

All embodiments shown in FIG. 1, 2, 3, 4, 5, and 6 are of bolt holder-spacer device 10 that attaches to a bolt and hangs from form board 60. All are bent or formed to have more than one spacer-arms, one or more bolt-holder sections, and form board attachment clip 20. The preferred embodiment of our invention is constructed of a single piece of wire 12. Lower spacer-arm 42 starts at a point on inside face of form board 66 and continues until it contacts a backside 82*b* of a anchor bolt shaft 82. From here wire 12 continues upwardly and away from a anchor bolt 80 until it reaches a re-bar seat end-point 52. Here it is bent approximately 180 degrees and returns downwardly to return to contact with a frontside 82*f* of anchor bolt shaft 82. This section of wire 12 from frontside 82*f* contact to re-bar seat end-point 52 forms re-bar seat 50.

From its return contact with frontside 82*f*, wire 12 is bent from here to tightly wrap around in an upwardly spiraling path completely encircling bolt shaft 82. It further continues around to a position on backside 82*b*. From here wire 12 projects away from bolt shaft 82 toward form board 60 forming upper spacer-arm 41. Upper spacer-arm 41 extends to inside face of form board 66 to a point beyond the vertical plane which is perpendicular to inside face 64 and which passes through bolt shaft 82.

The entire length of device 10 that is in contact with anchor bolt shaft 82 is a bolt-holder section 30. The lower part of this section is lower bolt-holder section 30*b* and the upper part is upper bolt-holder section 30*a*. Anchor bolt shaft 82 can have a notch or protrusion 96 which contacts a point of wire 12 encircling it.

An inboard leg 22 of attachment clip 20 connects to the end of upper spacer-arm 41 and travels up along inside face 66 to top edge of form board 62. At a place along the length of inboard leg 22 is located a break-off point 29. At the contact of inboard leg 22 with top edge 62, wire 12 becomes a connecting leg 24. From here it is bent to directly travel across top edge 62 to a outside face of form board 64 where it becomes a outboard leg 26. Outboard leg 26 travels down from and then is bent to return to top edge 62. From its connection with connecting leg 24 it travels toward and then through the continuation of the vertical plane which is perpendicular to inside face 64 and which passes through bolt shaft 82. At its return to top edge 62, outboard leg 24 becomes a stabilizing leg 28 and is bent to return partially back across top edge 62.

Figure 4:
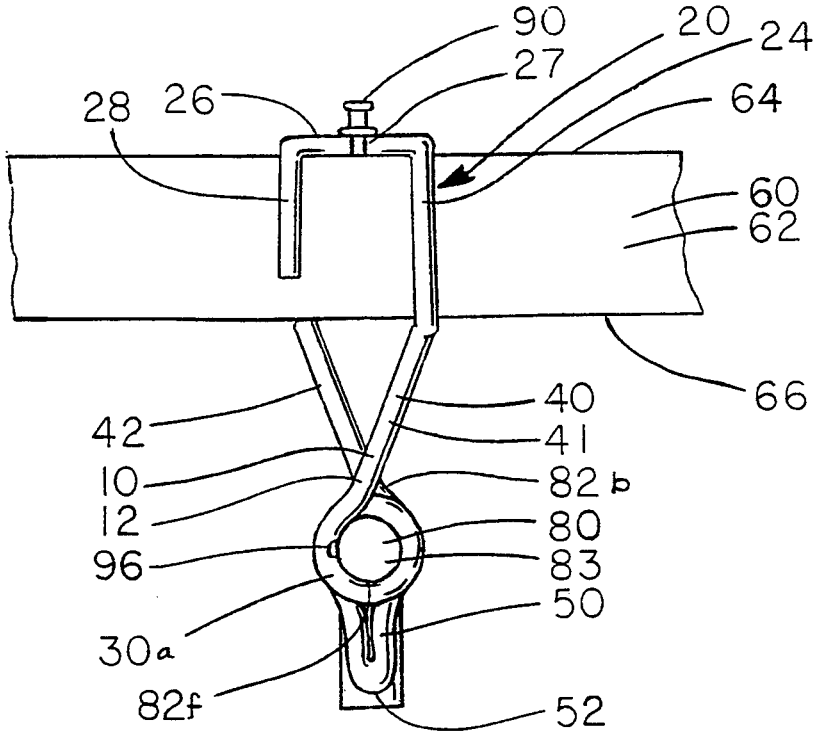
FIG. 4 is a top view of the preferred embodiment with anchor bolt installed and with device hung in position from form board.

Another embodiment of bolt spacer and holder device 10 can be found in FIG. 4 and 5 and is made from a single piece of sheetmetal 14. This device has upper bolt-holding section 30*a* and lower bolt-holding section 30*b* separated and so are connected with a vertical connecting-section 34 within the bolt-holding section 30. Upper bolt-holding section 30*a* and lower bolt-holding section 30*b* each has a hole 93 punched or drilled through it. The edges of these holes contain and hold anchor bolt shaft 82. Other parts of this embodiment are basically the same as the preferred embodiment and are so labeled.

OPERATION

Device 10 is used by attaching it to a bolt 80. With the preferred embodiment, a threaded end of the bolt 83 is pushed up through an opening 93 which is located at the base of re-bar seat 50. Threaded end 83 is further pushed through the path formed by the spiral bend of bolt-holder section 30. With the preferred embodiment and other embodiments, attached bolt 80 is located in such a position that threaded end 83 will protrude a correct length from top surface of finished concrete 88 to pass through and allow connection to a mudsill 94. Protrusion 96 on anchor bolt shaft 82, when placed correctly in device 10, provides resistance to dislodgment from its correct position in device 10.

Device 10 is then hung in position from form board 60 and can be attached to outside face 64 with a duplex nail 90. Re-bar 84 is then placed on seat 50 formed for it. Once concrete 86 has been poured and hardens, duplex nail 90 is removed and attachment clip 20 is broken off at 0 break-off point 29 below top surface of the finished concrete 88. Stabilizing leg 28 provides support to device 10 and therefore to anchor bolt 80.

When device 10 is used in constructing foundations with the two pour method of construction, most of the same procedure is followed. After the first pour, however, with the lower end of the bolt held tightly by the set concrete, the invention changes from a device for holding a bolt from a secured form board to a device for holding a form board from a secured bolt. Obstructions in the form of stakes supporting the formwork can be removed making easier the job of constructing a finished slab.

SUMMARY, RAMIFICATIONS, AND SCOPE

Thus the reader will see that the bolt spacer-holder device of the invention provides economical way to correctly set anchor and other construction bolts in foundation construction. Additionally he will see that the added benefit of achieving exact re-bar placement creates a device superior to any other device attempting to reach the same objectives.

While the above description contains many specificities, these should not be construed as limiting the scope of our invention but as merely providing illustrations of some of the presently preferred embodiments of this invention. While the embodiments described above are fabricated from sheet metal, and metal wire, other embodiments could be made of plastic. While the embodiments described above contain a seat for re-bar, other embodiments may be lacking this feature. While the embodiments described above use friction to hold a bolt in place, the bolt could be welded or glued to the device. While the embodiments described above have lower spacer-arm contacting the inside face of the form board at only one point, another embodiment may contact at more than one point. While embodiments described above have a part of the device connecting the upper and lower spacer-arms, another embodiment could use the shaft of the bolt itself to make this connection.

Thus the scope of the invention should be determined by the appended claims and their legal equivalents, rather than by the examples given.

What is claimed is:

1. A holder and spacer device for vertically positioning and holding securely a bolt a predetermined distance from a side-abutment perimeter form board, prior to and during placement of a concrete mixture, said concrete mixture to fill an area defined by said form board to a level of the top edge of said form board, said concrete mixture to set and become a concrete foundation, said device comprising:

a form board attachment clip, including a form board attachment means, a detachment means, whereby said form board attachment clip is detached from an upper spacer-arm and therefore the rest of said holder and spacer device, after said device is encased in said concrete mixture, said upper spacer-arm having two ends, one end of said upper spacer-arm connecting to said form board attachment clip, the other end of said upper spacer-arm located a predetermined distance away from an inside face of said perimeter form board and connecting to a bolt-holder section, said inside face being the vertical face of said form board which will contact said concrete mixture when placed, a lower spacer-arm, said lower spacer-arm having two ends, one end of said lower spacer-arm resting at a point on said inside face of the form board and the other end of said lower spacer-arm located a predetermined distance away from said inside face and connected to said bolt-holder section, whereby said lower spacer-arm provides support in fortifying the position of said bolt-holder section and therefore said bolt, said bolt-holder section including a bolt-holder member attached to said upper spacer-arm, said member attached to said lower spacer-arm, said bolt-holder member including holding means to vertically position and hold securely the shaft of said bolt, said holding means to hold said bolt so that a threaded end will protrude sufficiently from the generally level plane of the top surface of said concrete foundation to allow said threaded end to pass through the thickness of a mudsill and have attached to it a threaded nut, and said device formed so that when properly positioned on said perimeter form board, said upper spacer-arm, and said lower spacer-arm, and said bolt-holder section are positioned to be below the level of the generally horizontal plane of the top edge of said perimeter form board, whereby, except for said form board attachment clip, the entire device will be encased by said concrete mixture.

2. The holder and spacer device of claim 1 wherein said bolt-holder member is formed to a spiral shape around a vertically positioned void into which said bolt will be placed.

3. The holder and spacer device of claim 1 including a seat for the placement of re-bar, said seat comprising a projection projecting up and away from the shaft of said bolt, whereby said projection is of sufficient length and strength to provide adequate support for said re-bar.

4. The holder and spacer device of claim 1 wherein said holding means is a weld for welding said bolt-holder member to the shaft of said bolt.

5. The holder and spacer device of claim 1 wherein said device is formed from a single piece of wire.

6. The holder and spacer device of claim 1 wherein said device is constructed of sheet metal.

7. The holder and spacer device of claim 1 wherein said form board attachment clip includes an inboard leg attached to said one end of said upper spacer arm, said inboard leg positioned to contact said inside face of said form board, a connecting leg attached to one end of said inboard leg and positioned to lay across a top edge of said form board, a outboard leg attached to one end of said connecting leg and positioned to springably contact an outside face of said form board.

8. The holder and spacer device of claim 7 wherein said form board attachment clip includes a stabilizing leg connected to said outboard leg and is positioned to contact said outside face of the form board, said stabilizing leg bent to at least partially lay across the top edge of said form board, whereby said stabilizing leg helps maintain stability of said bolt.

9. The holder and spacer device of claim 1 wherein said detachment means includes a frangible means whereby said clip is broken off and .separated from the portion of said device encased in concrete.

10. A holder and spacer device for vertically positioning and holding securely a bolt a predetermined distance from a side-abutment perimeter form board, prior to and during placement of a concrete mixture, said concrete mixture to fill an area defined by said form board, to a level of the top edge of said form board, said device comprising:

a form board attachment clip including a form board attachment means, whereby said holder and spacer device is attached to said form board, at least one spacer-arm member including spacer means, wherein an end of said member is connected to said form board attachment clip, the other end of said spacer-arm member located a predetermined distance away from an inside face of said perimeter form board and connecting to a bolt-holder section, said inside face being the vertical face of said form board which will contact said concrete mixture when it is placed, a detachment means wherein said form board attachment clip can be separated from said spacer-arm member and the rest of said holder and spacer device, once said device is encased in said concrete mixture which has been placed and has set, said bolt-holder section including a bolt-holder member attached to said spacer-arm, said bolt-holder member formed to be substantially proximate to the shaft of said bolt, said bolt-holder section containing holding means to position and securely hold a shaft of said bolt in a vertical position, said holding means to hold said bolt so that a threaded end will protrude sufficiently above the plane of a top edge of said form board, whereby a building frame can be secured to a concrete foundation, and said device formed so that when properly positioned on said perimeter form board, said spacer arm and said bolt-holder member are positioned to be below the level of the generally horizontal plane of the top edge of said perimeter form board, whereby said spacer arm and said bolt-holder member will become encased in said concrete mixture.

11. The holder and spacer device of claim 10, including a re-bar seating means, whereby re-bar is placed on and held by said device to be in a useful position to be covered by concrete to be placed.

12. The holder and spacer device of claim 10, wherein said device is constructed of wire.

13. The holder and spacer device of claim 10, wherein said holding means of said bolt-holder section is a weld for welding said bolt-holder member to the shaft of said bolt.

* * * * *